United States Patent [19]

Adams

[11] 4,394,184

[45] Jul. 19, 1983

[54] DETERMINATION OF GRAIN REFINERS IN PHOSPHATE CONVERSION COATING BATHS

[75] Inventor: Richard G. Adams, Audubon, Pa.

[73] Assignee: Pennwalt Corporation, Philadelphia, Pa.

[21] Appl. No.: 362,572

[22] Filed: Mar. 26, 1982

[51] Int. Cl.[3] ..... C23F 7/08

[52] U.S. Cl. ..... 148/6.15 R; 148/6.15 Z; 436/55; 436/62; 436/103; 436/104

[58] Field of Search ..... 436/55, 62, 103, 104; 148/6.15 Z, 615 R

[56] References Cited

U.S. PATENT DOCUMENTS 4,057,440 11/1977 Alkiss ..... 148/6.15 Z

*Primary Examiner*—Sam Silverberg

[57] ABSTRACT

The amount of organic, phosphorous containing grain refiners in phosphate conversion coating baths is determined by precipitating the grain refiners and determining the difference in the chemical oxygen demand of the bath before and after the precipitation.

14 Claims, No Drawings

DETERMINATION OF GRAIN REFINERS IN PHOSPHATE CONVERSION COATING BATHS

BACKGROUND OF THE INVENTION

This invention relates generally to the formation of phosphate conversion coatings on metals and specifically to a process for monitoring the amount of grain refiner in the coating bath.

Baths for the formation of phosphate conversion coatings are used to form coatings on metals such as steel, iron, zinc, galvanized steel, cadmium and aluminum. The coatings provide adhesion promotion and corrosion resistance to the metal surfaces when the surfaces are painted. One type of coating bath contains divalent metal salts that form insoluble phosphates on the metal surface. The metal ions commonly present in these salts include zinc, zinc-nickel, zinc-magnesium, zinc-calcium, zinc-manganese, and manganese. The baths can be improved by the inclusion of grain refiners which act to make the coatings microcrystalline. The grain refiner provides thinner coatings having improved adhesion and enables metal sheets to be painted prior to forming operations which would otherwise cause paint cracking. Such coating baths with grain refiners are described, for example, in copending application Ser. No. 342,279, filed Jan. 25, 1982. The grain refiners described in this application are certain acidic organic phosphates and phosphonates. Effective amounts of certain of these grain refiners are in the range of only about 25–200 parts per million. For commercial operations, it is necessary to be able to monitor these very small amounts of grain refiner. One method which is frequently used to quantitatively determine phosphonates is to oxidize them to phosphates and analyze for the amount of phosphate present. With inorganic phosphate containing coating baths, this method, of course, cannot be used because of the large amounts of phosphate already present in the bath. Any method, to be successful, must also be relatively insensitive to the presence of contaminants which build up in the coating baths during use. I have now provided a method which permits the quantitive determination of small amounts of phosphorous containing grain refiner in a phosphate conversion coating bath.

BRIEF SUMMARY OF THE INVENTION

In accordance with this invention, there is provided a process for determining and periodically monitoring the concentration of a phosphorous containing organic grain refiner in an aqueous, acidic conversion coating bath which includes an inorganic divalent metal phosphate. The process comprises determining the chemical oxygen demand of the bath, precipitating the grain refiner from a portion of the bath by raising the pH to above about 4.0 in the presence of excess metal ion, determining the chemical oxygen demand of the precipitated portion of the bath, and determining the concentration of grain refiner in the bath from the difference between the chemical oxygen demand of the bath and the precipitated bath portion.

DETAILED DESCRIPTION

Aqueous, acidic, divalent metal phosphate conversion coating baths are normally prepared by mixing concentrated phosphoric acid and metal ions such as zinc, zinc-nickel, zinc-magnesium, zinc-calcium, zinc-manganese and manganese. Accelerators in the form of oxidizing materials are added to provide rapid coating formation.

Grain refiners are added to control the coating weight and crystal size. An effective group of grain refiners is described in copending application Ser. No. 342,279 filed Jan. 25, 1982 and includes certain acidic, organic phosphates and phosphonates which have at least one free alcoholic hydroxyl group. Specific examples of these grain refiners are; mixed esters of pentaerythritol acid phosphates, mixed esters of N,N,N',N'-tetrakis-(2-hydroxylpropyl)ethylene diamine acid phosphate, technical grade phytic acid, and 1-hydroxyethylidene-1,1-diphosphonic acid. They are used in amounts of from about 25 parts per million to 3.5 grams per liter.

The method is also useful in determining the amounts of other acidic, organic phosphorous containing materials such as glycerophosphonates and alcoholic phosphinates.

The process of the invention precipitates the grain refiner from the bath while at the same time leaving in solution most of the other organic constituents and impurities in the bath. This is done by raising the pH to a level of at least about 4.0 (preferably to at least about 6.5) in the presence of sufficient metal ions to precipitate the grain refiner. Suitable metal ions include, for example, zinc, nickel, magnesium, calcium, manganese, bismuth and lead which all form insoluble salts with the grain refiners when the pH of the solution is adjusted by adding a base such as the alkali metal (sodium or potassium) hydroxides. Although most of the grain refiner can be precipitated merely by adding a base to the divalent metal containing phosphate solution, additional metal ion should be added in order to assure the maximum precipitation of the grain refiner. The pH is raised to a high enough level to obtain the maximum precipitation of the grain refiner. This normally occurs at from about 6.5 to 7.0. A higher pH is not harmful to the process but is unnecessary. The inorganic phosphate in the bath may also precipitate but this is of no consequence because the process determines only organic material. Surprisingly, the process selectively removes the grain refiner such that even small amounts in the order of 100 ppm or less of grain refiner can be usefully determined in spite of the presence of other organic constituents as well as the contaminants which build up in a working bath during use.

The process employes chemical oxygen demand (COD) determinations made on samples of the bath before and after the precipitation of the grain refiner. The amount of grain refiner is found to correspond to the difference between the two COD determinations.

The COD technique is generally described, for example, in *Standard Method for the Examination of Water and Waste Water,* 14th Edition, page 550, jointly published by the American Public Health Assn., American Water Works Assn. and the Water Pollution Control Federation. The Hach Chemical Co. test kit for COD determination can be used.

According to the method, a COD reactor (115/230 V, 50/60 Hz Hach Company, Loveland, Colorado) is preheated to 150° C. Two 100 ml samples of the phosphate bath are heated almost to boiling and 10 ml of zinc sulfate solution (50 gms $Zn(SO_4).7H_2O$ in 100 ml water) are added to each. Using a pH meter standardized at pH 7 for 100° C., 50% w/w NaOH solution is slowly added to bring the pH of each solution to 6.5. The solution is then allowed to cool and settle. A 2 ml portion of the clear liquid is pipetted from each sample and the two portions are carefully added to COD digestion vials (low range 0–150 mg/L from Hach Company) which contain sulfuric acid and mercuric salts. Alternately, two 2 ml portions of a single 100 ml precipitated bath sample can be used. A blank is run using 2 ml of D. I. water. Two 2 ml samples of unprecipitated, filtered phosphate bath are also added to COD digestion vials. The capped vials are shaken to mix the contents and then placed in the COD reactor and heated at 150° C. for two hours, cooled below 120° C. and removed from the reactor. The COD is then determined on the contents of the vials either titrimetrically or colorimetrically.

The COD value in mg/L of the grain refiner is the difference between the average COD value of the two unprecipitated phosphate bath samples and the average COD value of the two precipitated samples.

The invention is further illustrated by, but is not intended to be limited to, the following examples wherein parts are parts by weight unless otherwise indicated.

EXAMPLE 1

A conversion coating bath was prepared by adding 99.8 grams of an aqueous concentrate to 3785 ml of water to form a solution containing by weight about 0.813% phosphate, 0.235% nitrate and 0.32% zinc ions. To one liter of the bath were added 113.7 mg of 1-hydroxyethylidene-1,1-diphosphonic acid and 50.9 mg of an organic wetting agent (Triton N-101). A 100 ml portion of the bath was precipitated by raising the pH to 6.5 with 50% sodium hydroxide. Two clear 2 ml samples each of the cooled, settled, precipitated portion and the filtered unprecipitated bath were pipetted into digestion vials (low range 0–150 mg/L from Hach Company) which contain sulfuric acid and mercuric salts. The capped vials were shaken to mix the contents and the placed in the COD reactor along with a blank made with 2.0 ml of distilled water. The vials were heated at 150° C. for two hours, cooled below 120° C., and removed from the reactor. When the vials had cooled, the caps were carefully removed and the sides of each vial were washed with 1 ml of distilled water. The vial contents were stirred magnetically and one drop of low range ferroin indicator solution was added. The contents were titrated with 0.0125 N ferrous ammonium sulfate standard solution until the sample color changed sharply from a greenish-blue to orange-brown. Because the ferrous ammonium sulfate solution strength changes with age, changes in titrant strength are determined and used in the COD calculations. In this determination, a 2.0 ml portion of 0.025 N potassium dichromate was pipetted into a clean vial and 3.0 ml of sulfuric acid were added with mixing. When cool, the resulting solution was titrated with the ferrous ammonium sulfate using ferroin indicator to the orange-brown endpoint. The COD in mg/L was calculated according to the following equation:

$$(A-B)\times(200/C)=\text{mg/L COD}$$

where A=ml used to titrate the blank
where B=ml used to titrate the sample
where C=ml used to titrate the potassium dichromate The COD results for the two precipitated samples were 124.18 mg/L and 119.50 mg/L and for the unprecipitated samples were 152.24 mg/L and 155.22 mg/L. The contribution to the COD value of the grain refiner is the difference between the average COD value of the phosphate bath and the average COD value of the precipitated bath sample or 31.94 mg/L COD. The expected value was 31.72 mg/L calculated as follows:

$$(0.279)^*(113.7)=31.72 \text{ mg/L.}$$

*where 0.279 is the factor supplied by the manufacturer for the theoretical chemical oxygen demand of this grain refiner.

EXAMPLE 2

In order to determine the extent to which the grain refiner is precipitated, 103.9 mg of the grain refiner of Example 1 was added to a one liter of the phosphate coating bath of Example 1 (which contained no wetting agent). To a 100 ml sample of this solution excess zinc ion (5 gms of zinc sulfate) was added and the pH of the sample was raised to about 6.5 with 50% w/w NaOH. The COD values of two 2 ml portions of the precipitated sample were determined by the method described in Example 1. The COD values were 1.69 mg/L and 2.25 mg/L for the two portions which indicates that a few parts per million of grain refiner still remained in the solution. Therefore, excess of metal ion should be added in order to minimize the amount of unprecipitated grain refiner which remains in the bath.

EXAMPLE 3

A used commercial phosphate conversion coating bath sample was obtained which contained phosphoric acid, nitric acid, zinc, nickel and hydrofluoric acid. To 500 ml of this bath, were added 55.7 mg of the 1-hydroxyethylidene-1,1-diphosphonic acid grain refiner. The COD values of two 100 ml samples, to which six grams each of $Bi(NO_3).5H_2O$ were added and the pH raised to 6.5 with caustic, were determined by the titration method of Example 1. Also, the COD values of the unprecipitated bath, with and without the grain refiner, were determined.

The COD value of the original bath sample was 50.00 mg/L, the COD value of the bath and grain refiner was 82.35 mg/L and of the precipitated bath 41.18 mg/L or a COD contribution of the grain refiner of 82.35 mg/L-41.18 mg/L=41.17 mg/L.

The difference between the expected value, (0.279)(55.7) (2)=31.08 mg/L, and the value found, 41.17 mg/L, was probably due to contaminants in the used bath which precipitated with the grain refiner.

In the following examples, the amounts of grain refiner were determined colorimetrically. The COD vials with 2 ml samples were prepared, heated and cooled in same manner as with the titrimetric method. A COD vial adaptor was placed in the cell holder of a DR/2 spectrophotometer and the wavelength was set at 420 nm. A COD low range meter scale (0-150 mg/l Cat. No. 41413-00, Hach Company, Loveland, Colorado) was inserted into the meter, the meter light switch was held in the zero check position, and the zero adjust was turned until the meter needle was on the extreme left mark on the scale. The switch was then returned to the on position. The COD vial with the blank solution was placed in the meter and the light control adjusted for a meter reading to zero mg/L. Each COD test sample vial in turn was placed in the meter and the mg/L was read from the meter scale.

EXAMPLE 4

To 100 liters of a commercial zinc phosphate solution containing 0.91% phosphate, 0.092% nitrate, 0.243% zinc and 0.031% nickel ions by weight, 5000 mg of the 1-hydroxyethylidene-1,1-diphosphonic acid grain refiner were added. Steel panels were coated periodically over a 2 month period using the coating solution. A determination was then made to measure the quantity of grain refiner remaining in the solution. Two 400 ml samples of the solution were boiled down to about 90 ml. The samples were cooled and 8 ml of reagent grade $H_2SO_4$ were added to dissolve any precipitate. The contents were quantitatively transferred to 100 ml volumetric flasks with D. I. water. It is advisable to use a large sample which is then concentrated by boiling down to a smaller volume if the COD value is expected to be at the lower end of the colorimetric scale. The COD reactor was preheated to 150° C. One 100 ml sample was heated almost to boiling and 10 ml of zinc sulfate solution was added. Using a pH meter, standardized at pH 7, 50% w/w sodium hydroxide solution was added slowly with stirring until the pH was 6.5. The sample was allowed to cool and settle. A 2 ml portion of the precipitated sample was added by pipet to a COD digestion reagent vial and a 2 ml portion of the unprecipitated sample was added to a COD digestion reagent vial. A blank was run using 2 ml of D.I. water. The vials were heated for two hours at 150° C. The vials were cooled and the COD measured using a DR/2 spectrophotometer and COD 0-150 mg/L meter scale. The COD results were:

| | COD |
|---|---|
| Unprecipitated Bath | 35 mg/L |
| Precipitated bath sample | 30 mg/L |
| COD Difference | |
| 35 − 30 = 5 mg/L | |
| $\frac{5\ mg/L}{4^*}$ = 1.25 mg/L COD contribution from the grain refiner | |

*Divided by 4 because a 400 ml bath sample was used $\frac{1.25\ mg/L}{0.279}$ = 4.48 mg/L of grain refiner remaining in the bath.

This example indicates that the grain refiner content of the solution had become depleted to a few parts per million during use.

EXAMPLE 5

Because in Example 4 the quantity of grain refiner was depleted, an additional 5000 mg of grain refiner was added to the 100 liter bath of the used phosphate coating solution of Example 4 and another determination was made using the same analytical method as in Example 4. The results were:

| | COD |
|---|---|
| Unprecipitated Bath | 89 mg/L |
| Precipitated bath sample | 28 mg/L |
| COD Difference: 89 − 28 = 61 mg/L | |
| $\frac{61\ mg/L}{4} = \frac{15.25\ mg/L}{0.279}$ = 54.66 mg/L of grain refiner | |

This result is very close to the expected value of about 50 mg/L+4.48 ml/g=54.48 mg/L.

I claim:

1. A process for determining the concentration of a phosphorous containing organic grain refiner in an aqueous, acidic conversion coating bath which includes an inorganic divalent metal phosphate comprising, determining the chemical oxygen demand of the bath, precipitating the grain refiner from a portion of the bath by raising the pH to above about 4.0 in the presence of excess metal ion, determining the chemical oxygen demand of the precipitated portion of the bath, and determining the concentration of grain refiner in the bath from the difference between the chemical oxygen demand of the bath and the precipitated portion of the bath.

2. The process of claim 1 wherein the grain refiner is precipitated by adding a base to raise the pH to at least about 4.0 in the presence of a metal ion which forms an insoluble salt with the organic phosphorous compound.

3. The process of claim 2 wherein the grain refiner is precipitated by raising the pH to at least about 6.5.

4. The process of claim 3 wherein the metal ion is selected from the group consisting of zinc, nickel, magnesium, calcium, manganese, bismuth, lead and mixtures thereof.

5. The process of claim 1 wherein the phosphate is zinc phosphate.

6. The process of claim 5 wherein the grain refiner is selected from the group consisting of acidic organic phosphates and phosphonates having at least one free hydroxyl group.

7. The process of claim 6 wherein the grain refiner is 1-hydroxyethylidene-1,1-diphosphonic acid.

8. In a process for forming a metal phosphate conversion coating on a metal surface which comprises contacting the metal surface with a heated, acidic, aqueous bath which includes a divalent metal phosphate, an oxidizing accelerator and a grain refiner selected from the group consisting of acidic organic phosphates and phosphonates having at least one free hydroxyl group, the improvement comprising monitoring the amount of grain refiner in the bath by periodically determining the chemical oxygen demand of the bath, precipitating the grain refiner from a portion of the bath by raising the pH to above about 4.0 in the presence of excess metal ion, determining the chemical oxygen demand of the precipitated portion of the bath, determining the concentration of grain refiner in the bath from the difference between the chemical oxygen demand of the bath and the precipitated bath sample and adjusting the amount of grain refiner in the bath to bring it to a desired concentration.

9. The process of claim 8 wherein the grain refiner is precipitated by adding a base to raise the pH to at least about 4.0 in the presence of a metal ion which forms an insoluble salt with the organic phosphorous compound.

10. The process of claim 9 wherein the grain refiner is precipitated by raising the pH to at least about 6.5.

11. The process of claim 10 wherein the metal ion is selected from the group consisting of zinc, nickel, magnesium, calcium, manganese, bismuth, lead and mixtures thereof.

12. The process of claim 8 wherein the phosphate is zinc phosphate.

13. The process of claim 12 wherein the grain refiner is selected from the group consisting of acidic organic phosphates and phosphonates having at least one free hydroxyl group.

14. The process of claim 13 wherein the grain refiner is 1-hydroxyethylidene-1,1-diphosphonic acid.

* * * * *